US008979478B2

(12) United States Patent
Andrews

(10) Patent No.: US 8,979,478 B2
(45) Date of Patent: Mar. 17, 2015

(54) FULLY ENCLOSED SEAL AND BEARING ASSEMBLY FOR BETWEEN-BEARING PUMPS

(75) Inventor: Dale B. Andrews, Derry, NH (US)

(73) Assignee: Flowserve Management Company, Irving, TX (US)

( * ) Notice: Subject to any disclaimer, the term of this patent is extended or adjusted under 35 U.S.C. 154(b) by 539 days.

(21) Appl. No.: 13/435,501

(22) Filed: Mar. 30, 2012

(65) Prior Publication Data

US 2012/0251293 A1 Oct. 4, 2012

Related U.S. Application Data

(60) Provisional application No. 61/469,241, filed on Mar. 30, 2011.

(51) Int. Cl.
*F01D 25/20* (2006.01)
*F04D 29/10* (2006.01)

(52) U.S. Cl.
CPC ..... *F04D 29/106* (2013.01)
USPC ..... 415/112

(58) Field of Classification Search
USPC ..... 415/109, 110, 111, 112, 116, 175; 416/174, 198 R, 201 R
See application file for complete search history.

(56) References Cited

U.S. PATENT DOCUMENTS 2,608,380 A * 8/1952 Rice ..... 415/175
4,632,402 A 12/1986 Daeyaert
6,309,174 B1 10/2001 Oklejas, Jr. et al.

FOREIGN PATENT DOCUMENTS

JP 2001107891 A 4/2001
JP 2011038528 A 2/2011

OTHER PUBLICATIONS

PCT Search Report for PCT Appl. No. PCT/US2012/031428, dated Mar. 30, 2012, 5 pages.

* cited by examiner

*Primary Examiner* — Edward Look
*Assistant Examiner* — Aaron R Eastman
(74) *Attorney, Agent, or Firm* — Maine Cernota & Rardin

(57) ABSTRACT

A bearing and seal assembly for supporting and sealing a terminating outboard end of an impeller shaft in a centrifugal pump such as a between-bearings pump includes only one seal but provides advantages typical of a dual-seal assembly, including barrier fluid protection against seal damage caused by abrasive slurries, and protection against leaking of toxic process fluid to atmosphere. A bearing housing sealed to the pump's pressure casing encloses the seal, bearing, and terminating impeller shaft end. Leakage of process fluid past the seal is prevented by a lubricating, pressurized, cooled barrier fluid which is circulated through the bearing housing by an external pump and/or by an internal, shaft-driven impeller. Because the impeller shaft terminates within the bearing housing and does not penetrate to atmosphere, the barrier fluid is contained within the bearing housing and a second seal is not required.

16 Claims, 5 Drawing Sheets

FULLY ENCLOSED SEAL AND BEARING ASSEMBLY FOR BETWEEN-BEARING PUMPS

RELATED APPLICATIONS

This application claims the benefit of U.S. Provisional Application No. 61/469,241, filed Mar. 30, 2011, which is herein incorporated by reference in its entirety for all purposes.

FIELD OF THE INVENTION

The invention relates to pumps, and more particularly, to pumps such as between-bearing centrifugal pumps which have a terminating outboard end.

BACKGROUND OF THE INVENTION

Some centrifugal pumps have "cantilevered" designs, wherein the impeller shaft is supported by bearings located on only one side of the impeller. Others are of a "between-bearing" design, whereby the impeller shaft is supported by bearings located on either side of the impeller. Often, the impeller shaft in a between-bearing pump is horizontal in orientation. Multistage centrifugal pumps are used extensively in high pressure pumping applications for which the pressure to be developed is greater than can be practically generated by a single impeller. For such multistage pumps, the inclusion of a plurality of pump impellers on a single shaft typically makes it necessary for the pump to be of a "between-bearing" design.

With reference to FIG. 1, a characteristic of between-bearing pumps 100 is that that the impeller drive shaft 3 penetrates the pressure casing 6 of the pump 100 and extends to atmosphere at two locations 102, one on either side of the pump 100. Leakage to atmosphere at these penetrations is typically controlled by mechanical shaft seals 4A, 4B on both sides of the pump 100, which effectively prevent objectionable quantities of pumped fluid from leaking to atmosphere. The bearings 8 are located beyond the seals 4A, 4B on either side. In some designs, the bearings 8 are surrounded by separate chambers 112 through which a lubricating and cooling fluid is circulated.

In most multistage pump designs the impellers 15 are arranged in series, whereby the low pressure inlet 104 is at a first end of the pump and the higher pressure discharge outlet 106 is at a second end of the pump. Thus, typically one or more mechanical shaft seals 4B at the second end must withstand a higher pressure than the shaft seals at the first end 4A, necessitating the use of seals of different designs and complexity within the same pump unit.

Some pumps must be able to handle slurries containing suspended solids which are abrasive. These abrasive solids are potentially damaging to the mechanical seals, which rely on highly polished surfaces separated by a micro-layer of fluid film to prevent wear and prevent leakage. It is well known within the art that fluids will flow along a path from high pressure to low pressure. To prevent a tendency for the abrasive solids in such cases to move across the seal faces from the high pressure internal region of the pump to atmosphere, a dual seal 108 is often used in conjunction with another clean fluid referred to as a barrier fluid.

A dual seal 108 typically includes two complete seal assemblies 4A, 4B mounted coaxially on a shaft adjacent to each other with a barrier fluid filling a space 110 between them, such that one seal is interposed between the pumped fluid and the barrier fluid and the other seal interposed between the barrier fluid and atmosphere. The barrier fluid 110 is maintained at a higher pressure than the pumped fluid, so as to maintain a positive flow of clean barrier fluid across the seal faces into the process.

Dual shaft seals 108 are also frequently used in applications for which the process fluid is highly toxic and/or flammable. The dual seal arrangement adds redundancy to the seal, thereby reducing the risk of a hazardous release to atmosphere. Nevertheless, seal failures do sometimes occur and product is sometimes released to the atmosphere, causing injury to life and property.

The inclusion of dual shaft seal assemblies 108 on a between-bearing pump 100 adds to the cost and complexity of the pump, in that it requires the use of two dual seal assemblies, one on each side of the pump, and therefore requires at least four seals in total.

What is needed, therefore, is a simplified sealing arrangement for a between-bearing centrifugal pump which allows abrasive slurries and highly toxic or flammable liquids to be pumped safely using fewer mechanical seals than the four seals traditionally required by a between-bearing pump with dual seal assemblies. It would be further desirable if the possibility of atmospheric release could be reduced by eliminating a leak path to atmosphere which is inherent in existing designs.

SUMMARY OF THE INVENTION

The present invention is a bearing and seal assembly intended for use on the outboard side of a centrifugal pump such as a between-bearings pump which has a terminating outboard end. The invention provides advantages typical of a dual-seal assembly, including barrier fluid protection against seal damage caused by abrasive slurries, while requiring only one seal and providing virtually no possibility of a process leak past the seal to atmosphere.

The bearing and seal assembly of the present invention does not require a second seal because the seal, the bearing, and the end of the pump shaft are all fully enclosed within a bearing housing which is sealed to the pressure casing of the pump. Because the pump shaft terminates within the bearing housing, there is no need for a second seal to permit penetration of the shaft beyond the assembly. A lubricating, cooled and pressurized barrier fluid is circulated through the interior of the bearing housing to protect the seal from abrasive matter in the process fluid. The interior of the bearing housing thereby serves a purpose similar to the space between the two seals of a traditional dual-seal assembly.

In embodiments, the seal of the present invention includes a rotary mechanical seal assembly which is mounted on the pump shaft. The rotary mechanical seal assembly engages a stationary mechanical seal assembly which is mounted within a seal housing, the seal housing being affixed to and sealed to the pump's pressure casing.

Outboard of the mechanical seal assembly is a bearing assembly that can be of any suitable design known in the art, such as a rolling element bearing or a hydrodynamic journal bearing, both of which are commonly known and applied. The stationary bearing elements are supported by the bearing housing.

The bearing housing includes inlet and outlet conduits that permit barrier fluid to be circulated in a closed loop between the interior of the bearing housing and a barrier fluid cooling and circulation system. In some embodiments, the barrier fluid is circulated by an independent pump. In various embodiments, the barrier fluid is pressurized by an external means, such as a backpressure control valve or a pressurization piston, such that the bearing housing is always maintained at a constant differential pressure at some predetermined offset from the pressure of the process fluid on the other side of the seal.

Various embodiments include a barrier fluid circulation impeller which is driven by the pump shaft and which circulates the barrier fluid from the inlet conduit, through the interior of the bearing housing, and out through the outlet conduit, thereby eliminating the need to use an exterior barrier fluid pump. In some of these embodiments, the outlet conduit is mounted tangential to the bearing housing, and/or the impeller is mounted to and rotates with the shaft by a centrifugal pumping action, such that barrier fluid is circulated through the interior of the bearing housing whenever the pump is running. This integral barrier fluid circulation system may be operated in parallel with a separate, electrically operated pump unit which circulates cooled lubricant to the bearings when the pump is on hot standby.

The present invention is a bearing and seal assembly for supporting and sealing a terminating outboard end of an impeller drive shaft included in a centrifugal pump, the centrifugal pump having a pump interior enclosed by a pump pressure casing. The bearing and seal assembly include a shaft seal coaxially surrounding the pump drive shaft and sealed to the pump pressure casing, the shaft seal being able to resist penetration of process fluid from the pump interior to a region exterior to the pressure casing; a support bearing coaxially surrounding and supporting the pump drive shaft, the support bearing being distal to the shaft seal and proximal to the terminating end of the pump drive shaft; a bearing housing sealed to the pump pressure casing, the bearing housing having an interior which encloses the terminating end of the pump drive shaft, the support bearing, and a distal side of the shaft seal, the bearing housing being able to resist penetration of pressurized fluid from the interior of the bearing housing to a region outside of the bearing housing; and an inlet conduit and an outlet conduit suitable for connection to an external barrier fluid supply system so as to provide fluid communication between the barrier fluid supply system and the interior of the bearing housing, the inlet conduit and the outlet conduit thereby enabling a barrier fluid to be provided from the external barrier fluid supply system to the interior of the barrier housing.

In embodiments, the outlet conduit is coaxial with the pump drive shaft.

Various embodiments further include a barrier fluid circulating mechanism operable by the pump drive shaft and configured to draw barrier fluid through the inlet conduit into the interior of the bearing housing, and to propel barrier fluid out of the interior of the barrier housing through the outlet conduit. In some of these embodiments the barrier fluid circulating mechanism includes a barrier fluid impeller which is fixed to and coaxial with the pump drive shaft, and the outlet conduit is tangential to the barrier fluid impeller so as to accept barrier fluid propelled thereby.

In certain embodiments the bearing housing is symmetrically located about a longitudinal axis of the pump drive shaft. In some embodiments, the bearing is a rolling element bearing. In other embodiments the bearing is a journal bearing. In certain embodiments the bearing is a tilting pad bearing.

Various embodiments further include an external barrier fluid supply system. In some of these embodiments the external barrier fluid supply system includes a barrier fluid pressurizing mechanism. In some of these embodiments the barrier fluid pressurizing mechanism is able to supply barrier fluid to the interior of the bearing housing at a pressure which is higher than a pressure of a process fluid contained in the pump interior on a proximal side of the shaft seal. In other of these embodiments the barrier fluid pressurizing mechanism includes a backpressure control valve. And in other of these embodiments the barrier fluid pressurizing mechanism includes a pressure regulating piston.

Other embodiments that further include an external barrier fluid supply system further include a barrier fluid cooling system. Still other of these embodiments further include a barrier fluid circulation pumping system. In yet other of these embodiments the barrier fluid circulation pumping system includes a barrier fluid circulation pump which is located external to the interior of the bearing housing and is operated by a source of power other than the pump drive shaft.

In still other of these embodiments the barrier fluid circulation pumping system includes a barrier fluid circulation impeller which is located within the interior of the bearing housing and is operated by the pump drive shaft. And in some of these embodiments wherein the barrier fluid impeller is fixed to and coaxial with the pump drive shaft, and the outlet conduit is tangential to the barrier fluid impeller so as to accept barrier fluid propelled thereby. And other of these embodiments further include an electrically operated pump unit which can circulate barrier fluid between the barrier fluid supply system and the interior of the bearing housing when the centrifugal pump is not operating.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
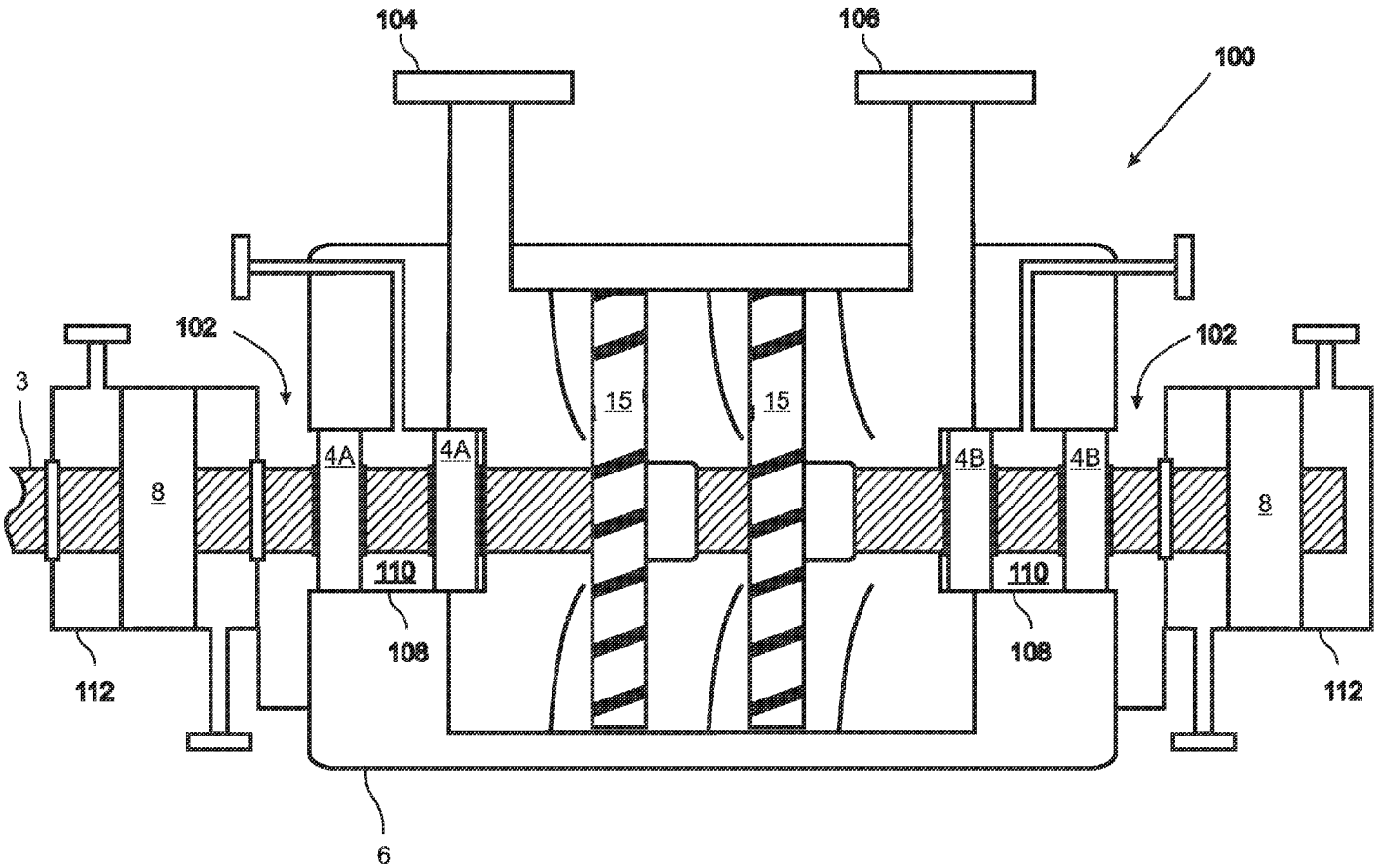
Figure 1 Prior Art
FIG. 1 is a perspective cut-away illustration of a prior art pump design for which the impeller shaft penetrates to atmosphere near both the inboard and outboard support bearings.
Figure 2:
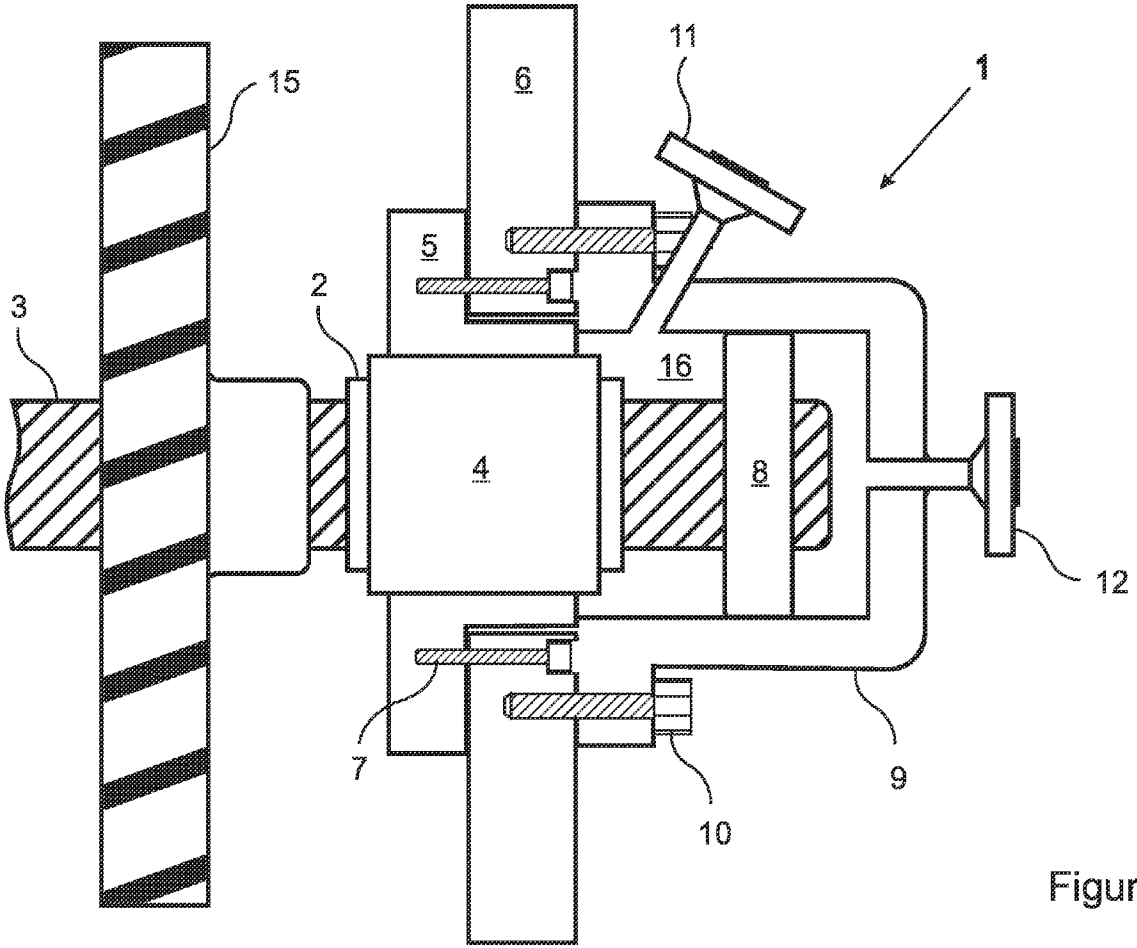
FIG. 2 is a cross sectional illustration of the bearing and seal assembly of an embodiment of the present invention having an axial outlet conduit and intended for use with an external barrier fluid pump.

FIG. 2 is a partially cross-sectional illustration of an embodiment 1 of the present invention which includes a rotating mechanical seal 2 coaxially mounted on pump impeller drive shaft 3, and an axially engaging stationary seal 4 which is coaxially mounted in seal housing 5. Seal housing 5 is secured to the pressure casing 6 of the pump by some mechanical sealing attachment mechanism 7 known in the art. Bearing 8 is coaxially mounted on the pump drive shaft 3 on the outboard side of the rotating mechanical seal 2. Bearing housing 9 is coaxially mounted and sealed to the pressure casing 6 of the pump by an attachment and sealing mechanism 10 known in the art. An inlet conduit 11 and an outlet conduit 12 are affixed to the bearing housing 9 by welding, threading, or some other temporary or permanent mechanism. The outlet conduit 12 in this embodiment is coaxial with the drive shaft 3. The distal end of the pump drive shaft 3 terminates within the bearing housing 9, which also encloses the bearing 8 and the distal side of the stationary seal 4. Note that for clarity of illustration elements 2, 4, 8, and 15 are not shown in cross section in FIG. 2.

Figure 3:
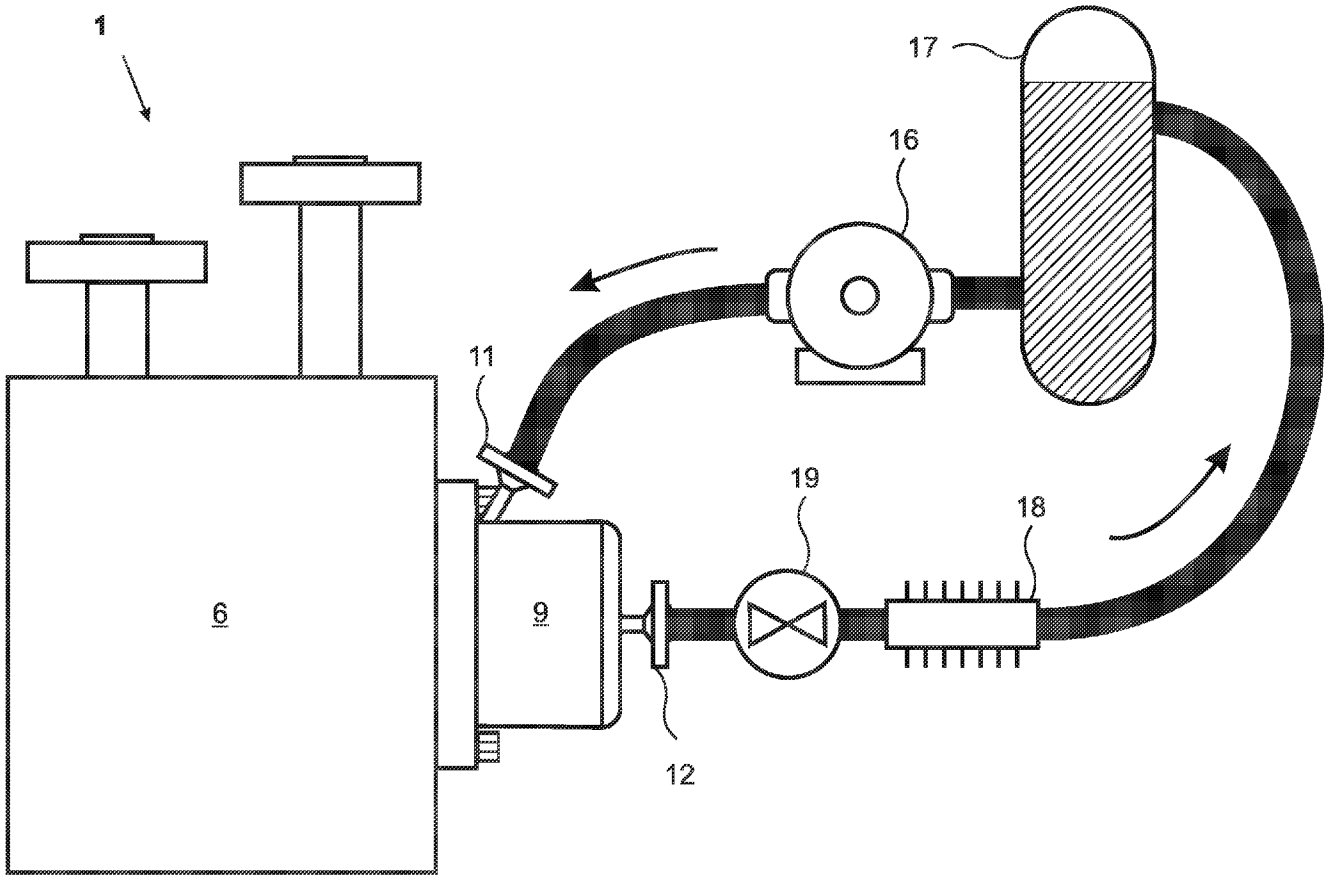
FIG. 3 is a side view of the embodiment of FIG. 2 connected to a barrier fluid circulation system driven by an external pump.

In operation, a suitable barrier fluid which is capable of cooling and lubricating the mechanical seal 2, 4 and bearing 8 is injected through inlet conduit 11 at a pressure higher than the pumped process pressure. During operation, the bearing and seal assembly 1 in the embodiment of FIG. 2 is hydrostatically full. Barrier fluid entering at inlet conduit 11 causes an equivalent volume of barrier fluid to be displaced and to exit the bearing housing 9 at conduit 12. With reference to FIG. 3, the barrier fluid can be driven by an independent pump 16 so as to circulate in a closed loop circuit between the interior of the bearing housing 9 and an external barrier fluid supply system which typically includes a fluid reservoir 17 and a barrier fluid cooler 18.

The barrier fluid is typically also pressurized by an external mechanism of the barrier fluid supply system, such that the bearing housing 9 is always maintained at a constant differential pressure at some predetermined level higher than the process fluid on the other side of the seal 2, 4 and the pump pressure casing 6. In the embodiment of FIG. 3, the pressurization mechanism is a backpressure control valve 19. By designing both the inboard and outboard seals to operate at the same pressure differential with the process fluid on the other side of the pressure casing 6, identical seals may be used for the outboard seal and bearing assembly 1 of the present invention and for a conventional dual-seal assembly provided on the inboard side of the pump. Should the outboard mechanical seal 2 suffer a catastrophic failure, the process fluid will be contained within the interior of the bearing housing 9 and the closed loop bearing fluid circulation system. Since the pump drive shaft 3 does not penetrate the bearing housing 9, there is no need for an additional seal assembly, nor is there a possibility of process leakage along the shaft 3 and past the seal 2, 4 to atmosphere.

Figure 4:
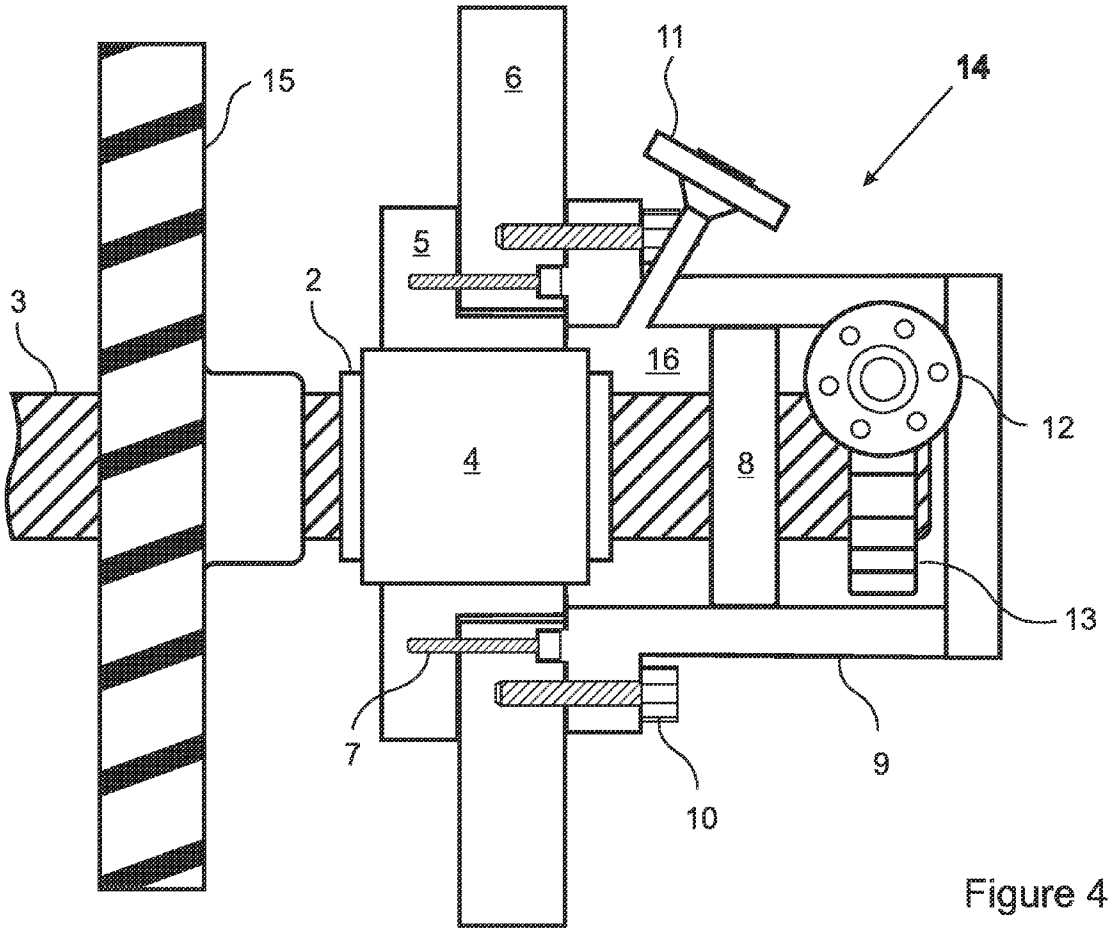
FIG. 4 is a cross sectional illustration of the bearing and seal assembly of an embodiment of the present invention which includes an integrally mounted barrier fluid circulation impeller and a tangential outlet conduit.
Figure 5:
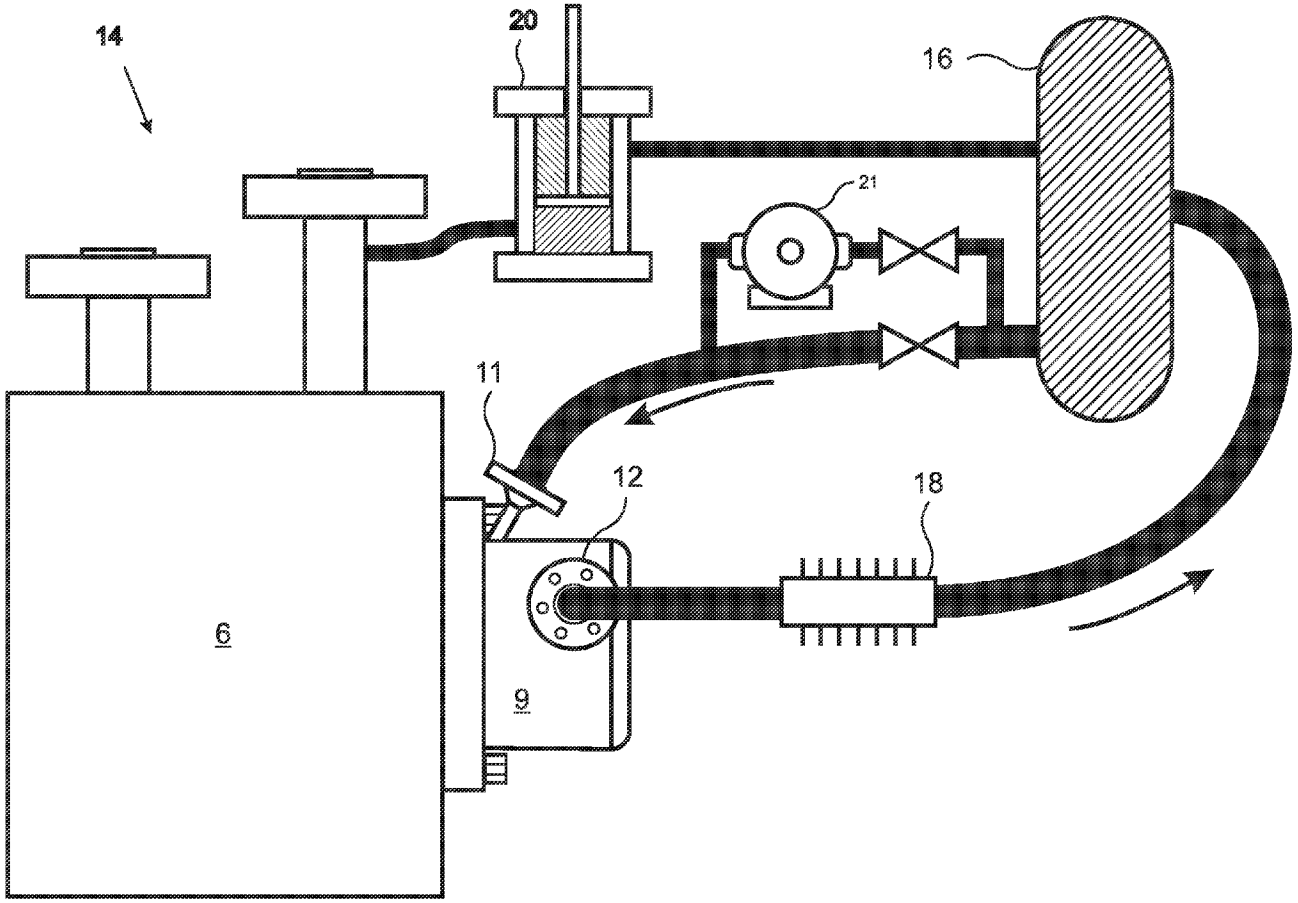
FIG. 5 is a side view of the embodiment of FIG. 4 connected to a barrier fluid circulation system that includes an auxiliary circulation pump.

Referring to FIG. 4, some embodiments 14 of the present invention include a barrier fluid impeller 13 which is driven by the pump drive shaft 3 and integral with the seal and bearing assembly. In the embodiment of FIG. 4, the outlet conduit 12 is mounted tangentially to the bearing housing 9, and the circulation impeller 13 is coaxially mounted to the shaft 3. With reference to FIG. 5, this embodiment includes a closed loop bearing fluid circulation system with a cooler 18 for cooling the circulating barrier fluid, the barrier fluid circulation system being connected to the outlet conduit 12 and the inlet conduit 11 of the bearing housing 9. Note that for clarity of illustration elements 2, 4, 8, 12, 13, and 15 are not shown in cross section in FIG. 2.

In operation, the barrier fluid is circulated by the impeller 13, which discharges barrier fluid from the interior of the bearing housing 9 through the outlet conduit 12 and into a closed loop barrier fluid circulation system which is typically pressurized by some external pressurizing mechanism. The bearing fluid pressurization mechanism in FIG. 5 is a piston 20 that divides a cylinder into two sections. The piston rod extends through the section that is in fluid communication with the bearing fluid system, thereby causing the surface area of the piston for that section to be less than the surface area of the piston facing the section that is in fluid communication with the process. The net result is that the bearing fluid system is always maintained at a higher pressure than the process, with the differential being controlled by the diameter of the piston rod.

The barrier fluid which is discharged by the circulation impeller 13 from the interior of the bearing housing 9 though the outlet conduit causes an equivalent amount of barrier fluid to be displaced from the closed loop barrier fluid circulation system and back into the interior of the bearing housing 9 via the inlet conduit 11. If needed, the barrier fluid circulation system may be operated in parallel with a separate electrically operated pump unit 21 which can circulate cooled barrier fluid to the bearing 8 and seal 2, 4 within the bearing housing 9 when the pump is on hot standby.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A bearing and seal assembly for supporting and sealing a terminating outboard end of an impeller drive shaft included in a centrifugal pump, the centrifugal pump having a pump interior enclosed by a pump pressure casing, the bearing and seal assembly comprising:

a shaft seal coaxially surrounding the pump drive shaft and sealed to the pump pressure casing, the shaft seal being able to resist penetration of process fluid from the pump interior to a region exterior to the pressure casing;

a support bearing coaxially surrounding and supporting the pump drive shaft, the support bearing being distal to the shaft seal and proximal to the terminating end of the pump drive shaft;

a bearing housing sealed to the pump pressure casing, the bearing housing having an interior which encloses the terminating end of the pump drive shaft, the support bearing, and a distal side of the shaft seal, the bearing housing being able to resist penetration of pressurized fluid from the interior of the bearing housing to a region outside of the bearing housing;

an inlet conduit and an outlet conduit suitable for connection to an external barrier fluid supply system so as to provide fluid communication between the barrier fluid supply system and the interior of the bearing housing, the inlet conduit and the outlet conduit thereby enabling a barrier fluid to be provided from the external barrier fluid supply system to the interior of the barrier housing; and a barrier fluid circulating mechanism operable by the pump drive shaft and configured to draw barrier fluid through the inlet conduit into the interior of the bearing housing, and to propel barrier fluid out of the interior of the barrier housing through the outlet conduit.

2. The bearing and seal assembly of claim 1, wherein the barrier fluid circulating mechanism includes a barrier fluid impeller which is fixed to and coaxial with the pump drive shaft, and the outlet conduit is tangential to the barrier fluid impeller so as to accept barrier fluid propelled thereby.

3. The bearing and seal assembly of claim 1, wherein the bearing housing is symmetrically located about a longitudinal axis of the pump drive shaft.

4. The bearing and seal assembly of claim 1, wherein the bearing is a rolling element bearing.

5. The bearing and seal assembly of claim 1, wherein the bearing is a journal bearing.

6. The bearing and seal assembly of claim 1, wherein the bearing is a tilting pad bearing.

7. The bearing and seal assembly of claim 1, further comprising an external barrier fluid supply system.

8. The bearing and seal assembly of claim 7, wherein the external barrier fluid supply system includes a barrier fluid pressurizing mechanism.

9. The bearing and seal assembly of claim 8, wherein the barrier fluid pressurizing mechanism is able to supply barrier fluid to the interior of the bearing housing at a pressure which is higher than a pressure of a process fluid contained in the pump interior on a proximal side of the shaft seal.

10. The bearing and seal assembly of claim 8, wherein the barrier fluid pressurizing mechanism includes a pressure regulating piston.

11. The bearing and seal assembly of claim 7, further comprising a barrier fluid cooling system.

12. The bearing and seal assembly of claim 7, further comprising a barrier fluid circulation pumping system.

13. The bearing and seal assembly of claim 7, wherein the barrier fluid circulation pumping system includes a barrier fluid circulation pump which is located external to the interior of the bearing housing and is operated by a source of power other than the pump drive shaft.

14. The bearing and seal assembly of claim 7, wherein the barrier fluid circulation pumping system includes a barrier fluid circulation impeller which is located within the interior of the bearing housing and is operated by the pump drive shaft.

15. The bearing and seal assembly of claim 14, wherein the barrier fluid impeller is fixed to and coaxial with the pump drive shaft, and the outlet conduit is tangential to the barrier fluid impeller so as to accept barrier fluid propelled thereby.

16. The bearing and seal assembly of claim 14, further comprising an electrically operated pump unit which can circulate barrier fluid between the barrier fluid supply system and the interior of the bearing housing when the centrifugal pump is not operating.

* * * * *